US006121955A

United States Patent [19]

Liu

[11] Patent Number: 6,121,955

[45] Date of Patent: Sep. 19, 2000

[54] COMPUTER JOYSTICK HAVING TWO OPTICAL SENSORS FOR GENERATING VECTOR SIGNALS

[75] Inventor: Shu-Ming Liu, Taipei, Taiwan

[73] Assignee: Primax Electronics Ltd., Hsien, Taiwan

[21] Appl. No.: 08/984,371

[22] Filed: Dec. 3, 1997

[30] Foreign Application Priority Data

Aug. 6, 1997 [CN] China ..... 86111285

[51] Int. Cl.[7] ..... G09G 5/08

[52] U.S. Cl. ..... 345/161; 345/162

[58] Field of Search ..... 345/156, 157, 345/161, 162, 163, 164, 165, 166, 169, 168; 74/471; 273/148 B; 250/221, 214 PR

[56] References Cited

U.S. PATENT DOCUMENTS 3,541,521 11/1970 Kater ..... 345/165
4,533,827 8/1985 Fincher ..... 250/211 K

FOREIGN PATENT DOCUMENTS 64-88734 4/1989 Japan .
2-99435 8/1990 Japan .
4-20134 2/1992 Japan .

*Primary Examiner*—Xiao Wu

[57] ABSTRACT

The invention discloses a computer joystick having two optical sensors to generate vector signals for indicating the current position of the joystick's handle. The computer joystick comprises a housing having an opening at its top, two mutually perpendicular shafts rotatably installed inside the housing, a joystick handle rotatably installed in the opening of the housing, an engaging means mounted at a bottom end of the joystick handle for rotatably engaging the two shafts, two optical sensors installed in the housing close to the two shafts for detecting rotations of the two shafts and generating corresponding displacement signals, and a control circuit having a memory for storing a coordinate as a position of the joystick handle, and a processor wired to the two optical sensors for updating the coordinate of the joystick handle according to the displacement signals generated by the two optical sensors and generating vector signals according to the coordinate of the joystick handle to indicate the current position of the joystick handle.

3 Claims, 2 Drawing Sheets

COMPUTER JOYSTICK HAVING TWO OPTICAL SENSORS FOR GENERATING VECTOR SIGNALS

BACKGROUND OF THE INVENTION

1. Field of the Invention

The present invention relates to a computer joystick, more particularly, to a computer joystick having two optical sensors for generating vector signals to indicate the current position of the joystick's handle.

2. Description of the Prior Art

Computer joysticks are usually used as two-dimensional pointing control systems which use a rotatable joystick handle to continuously generate two-dimensional vector signals each represents a current position of the joystick handle. The vector signals generated by a joystick are different from the displacement signals generated by a mouse which indicate the amount and direction of each displacement of the mouse instead of a position of the mouse.

A conventional computer joystick usually comprises a housing, a joystick handle rotatably installed in the housing for driving two rotatable shafts inside the housing, two position detectors made by variable resistors to detect tilted angles of the two shafts, and a control circuit connected to the two position detectors for generating vector signals to indicate the tilted angles of the two shafts which indicate the current position of the joystick handle. One major drawback of the conventional computer joystick is that the two variable resistors can easily be damaged by frequent or forceful use of the joystick handle. Inaccurate measurements of the tilted positions of tie two shafts may be reported by the two variable resistors when they are damaged by the frictional forces exerted insides the variable resistors.

SUMMARY OF THE INVENTION

It is therefore an objective of the present invention to provide a computer joystick having two optical sensors to generate vector signals to indicate the current position of the joystick's handle so that the above mentioned problem can be solved.

In a preferred embodiment, the present invention provides a computer joystick comprising:

a housing having an opening at its top;

a joystick mechanism comprising two mutually perpendicular shafts rotatably installed inside the housing, a joystick handle rotatably installed in the opening of the housing, and an engaging means mounted at a bottom end of the joystick handle for rotatably engaging the two shafts;

two optical sensors installed at one side of the two shafts for detecting rotations of the two shafts and generating corresponding displacement signals; and a control circuit having a memory for storing a coordinate as a position of the joystick handle, and a processor wired to the two optical sensors for updating the coordinate of the joystick handle according to the displacement signals generated by the two optical sensors and generating vector signals according to the coordinate of the joystick handle to indicate the current position of the joystick handle.

It is an advantage of the present invention that the computer joystick uses two optical sensors and a control circuit to generate the vector signals and the problem caused by the variable resistors used in traditional joysticks can thus be solved.

These and other objectives of the present invention will no doubt become obvious to those of ordinary skill in the art after reading the following detailed description of the preferred embodiment which is illustrated in the various figures and drawings.

DETAILED DESCRIPTION OF THE PREFERRED EMBODIMENT

Figure 1:
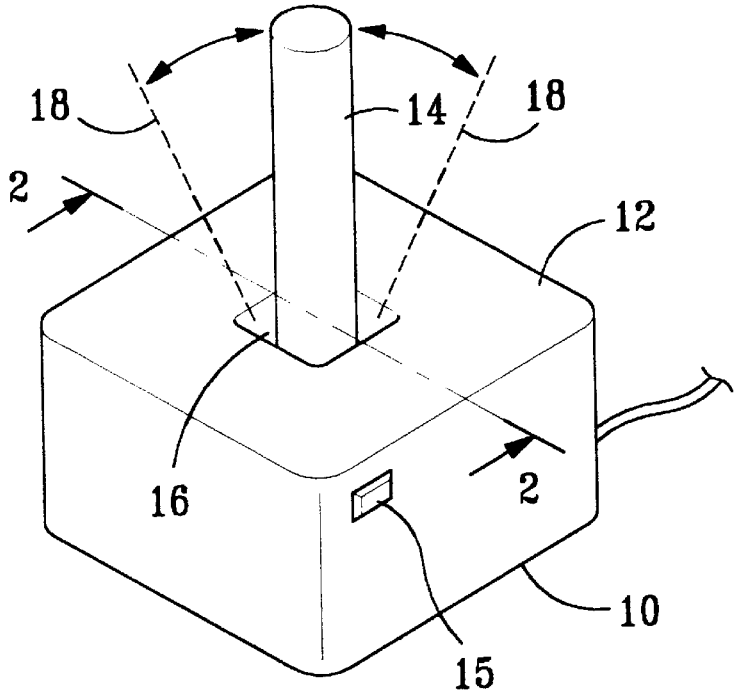
FIG. 1 is a perspective view of a computer joystick according to the present invention.

Please refer to FIG. 1. FIG. 1 is a perspective view of a computer joystick 10 according to the present invention. The computer joystick 10 comprises a housing 12 with an opening 16 at its top, a joystick handle 14 rotatably installed in the opening 16 which can be rotated within the angle 18, and a calibrating button 15 for calibrating the position of the joystick handle 14.

Figure 2:
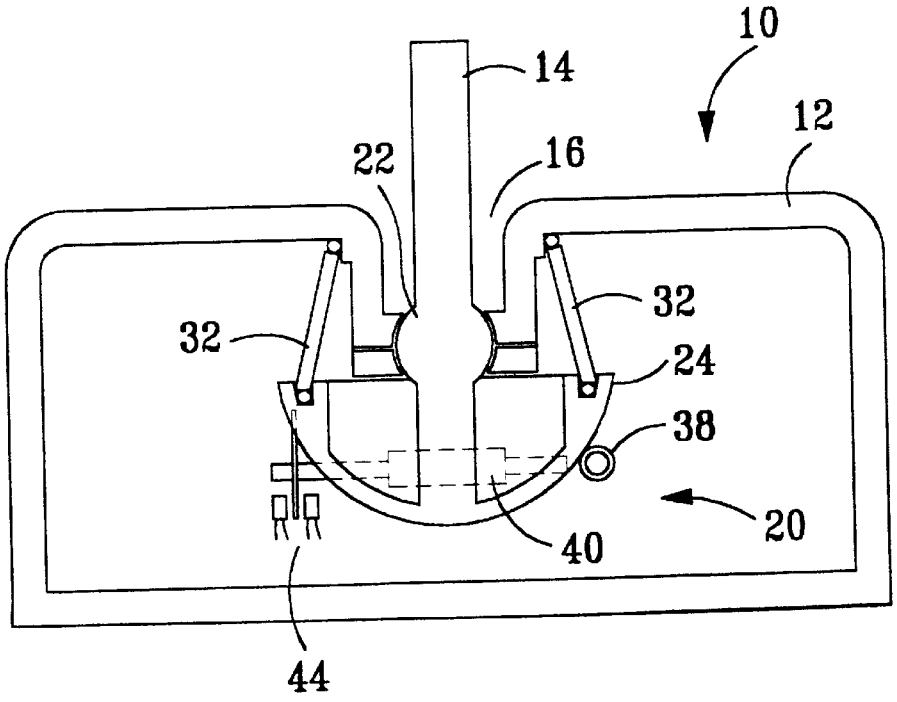
FIG. 2 is a sectional view along line 2—2 of the computer joystick shown in FIG.1.
Figure 3:
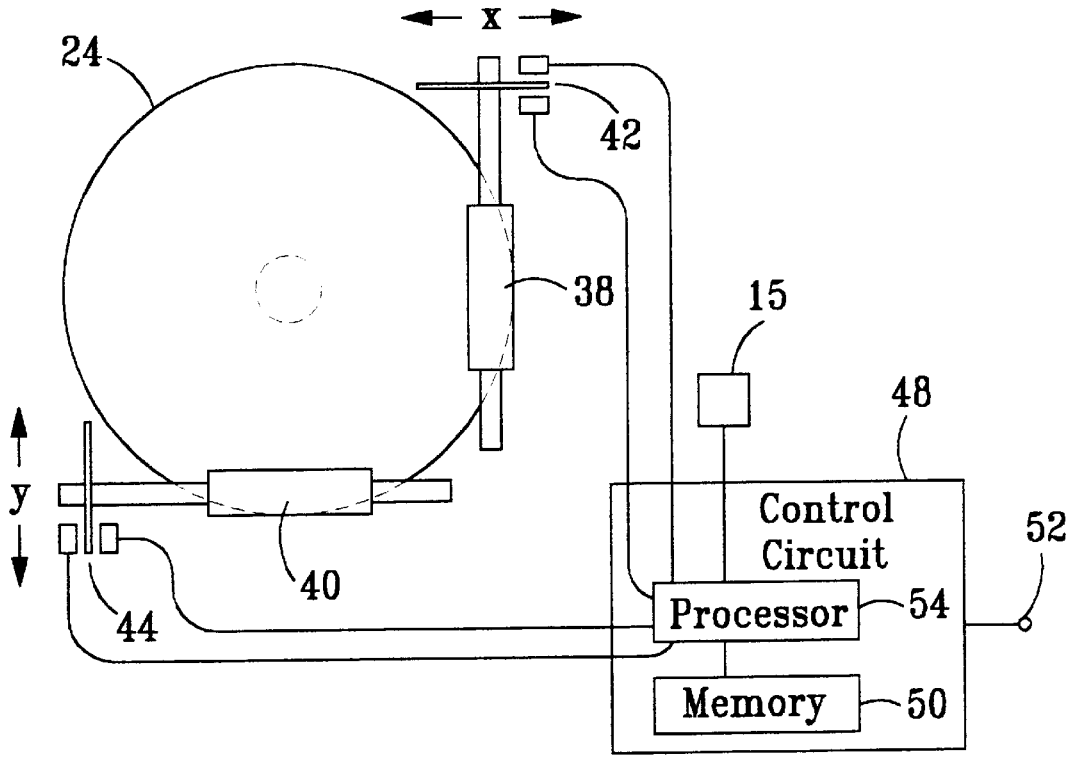
FIG. 3 is a diagrammatic view which shows the control circuit and two optical sensors of the joystick shown in FIG.2.

Please refer to FIGS. 2 and 3. FIG. 2 is a sectional view along line 2—2 of the joystick 10 shown in FIG.1 which shows the mechanical structure of the joystick 10. FIG. 3 is a diagrammatic view which shows the control circuit 48 and two optical sensors 42 and 44 of the joystick 10 shown in FIG.2. The computer joystick 10 comprises a housing 12 with an opening 16 at its top, a joystick mechanism 20, two optical sensors 42 and 44, a control circuit 48, and a calibrating button 15. The joystick mechanism 20 comprises two mutually perpendicular shafts 38 and 40 rotatably installed inside the housing 12 for measuring rotations of the joystick handle 14 toward the X and Y directions, a joystick handle 14 rotatably installed at the opening 16, a hemispherical engaging means 24 installed at the bottom of the joystick handle 14 for rotatably engaging the two shafts 38 and 40, and a spiral spring 32 installed between the engaging means 24 and the housing 12 for maintaining the joystick handle 14 in an upright position.

The two optical sensors 42 and 44 are installed in the housing 12 next to the two shafts 38 and 40 for detecting rotations of the shafts 38 and 40 and generating corresponding displacement signals. The control circuit 48 comprises a memory 50 for storing a coordinate as a position of the joystick handle 14 and a processor 54 wired to the two optical sensors 42 and 44 for updating the coordinate according to the displacement signals so that the coordinate stored in the memory 50 can always indicate the current position of the joystick handle 14. The processor 54 further generates vector signals according to the coordinate to indicate the current position of the joystick handle 14 and transmits the vector signals to a connected computer (not shown) through an output port 52.

The joystick handle 14 comprises a ball-shaped knob 22 at its middle portion and a hemispherical engaging means 24 mounted at its bottom of the joystick handle 14 for rotatably engaging the two shafts 38 and 40. The knob 22 of the joystick handle 14 is rotatably mounted in the opening 16 of the housing 12 so that the joystick handle 14 can be rotated within the angle 18. When the upper end of the joystick handle 14 is rotated by a hand, the engaging means 24 will cause rotations of the two shafts 38 and 40 along X and/or Y directions and the two optical sensors 42 and 44 will generate corresponding displacement signals to indicate displacements of the two shafts 38 and 40 in the same time. The processor 54 will calculate the displacements ΔX and ΔY of the two shafts 38 and 40 according to the displacement signals generated by the two optical sensors 42 and 44, and update the coordinate stored in the memory 50 so that the current position of the joystick handle 14 can be maintained. Meanwhile, the processor 54 continues to generate vector signals over the output port 52 according to the position of the joystick handle 14 stored in the memory 50.

In order to accurately track the current position of the joystick handle 14, the processor 54 must continuously update the coordinate stored in the memory 50 according to the displacements signals generated by the two optical sensors 42 and 44. If any error occurs in the updating process due to erroneous signals or any other reason, the error(s) will be accumulated in the coordinate forever unless the coordinate can be calibrated. Some calibration processes must be used to calibrate the coordinate stored in the memory 50. Besides, the joystick 10 should be calibrated when it is powered on so as to set an initial coordinate in the memory 50.

Many methods can be devised to calibrate the coordinate of the joystick handle 14 stored in the memory 50. The calibrating button 15 is used for calibrating the coordinate of the joystick handle 14. One method to calibrate the coordinate is to set the coordinate to a start position such as (0,0) when the joystick handle 14 is in an upright position and with no external force exerted on it. A user can depress the calibrating button 15 when the joystick handle 14 is set to such a predetermined position and the processor 54 will set the coordinate to (0,0) immediately. The computer connected to the joystick 10 can also be used to calibrate the coordinate of the joystick 10. It can provide an instruction in its monitor to indicate the user to set the joystick handle 14 to such a predetermined position and then send an instruction to the joystick 10 to have the processor 54 to set the coordinate to the predetermined position. In this case the calibrating button 15 can be eliminated from the joystick 10 so as to reduce the cost of the joystick 10.

Figure 4:
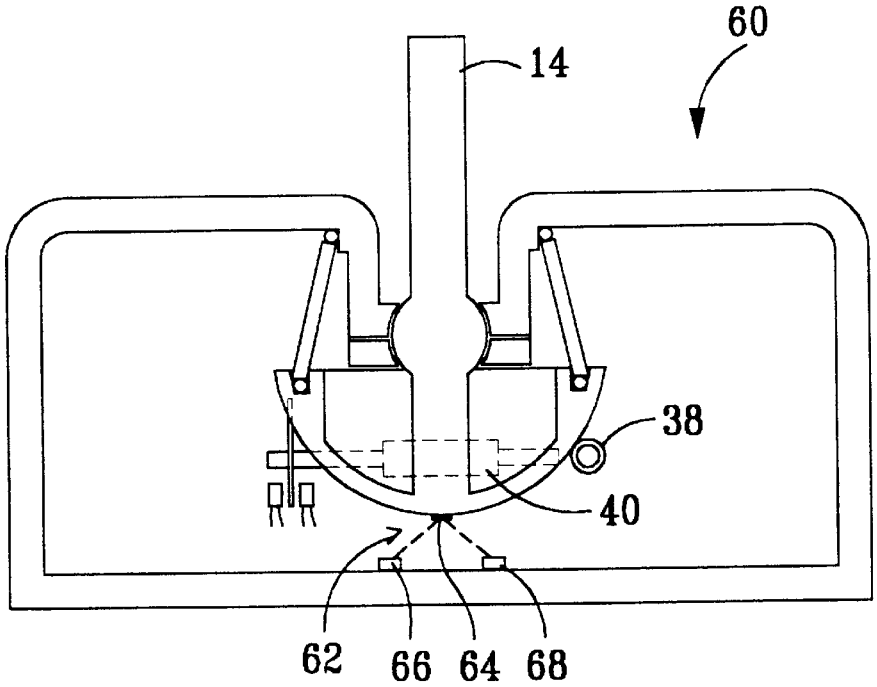
FIG. 4 is a sectional view of another computer joystick according to the present invention.

Manual calibration methods require human interactions and thus are inconvenient to end users. Automatic calibration methods can be devised to solve such problems and FIG. 4 shows such an examples. FIG. 4 is a sectional view of another computer joystick 60 according to the present invention. The computer joystick 60 differs from the computer joystick 10 in that it uses a detector 62 for calibrating the coordinate of the joystick handle 14 instead of using the calibrating button 15. The control circuit of the computer joystick 60 is similar to that of the computer joystick 10 shown in FIG. 3 except that the calibrating button 15 is replaced by the detector 62.

The detector 62 installed under the joystick handle 14 comprises a reflecting device 64 mounted at the bottom of the joystick handle 14 for reflecting light, a light source 66 for emitting light, and a light detector 68 for receiving the light emitted from the light source 66 through the reflecting device 64 when the joystick handle 14 is in a predetermined upright position. Whenever the light detector 68 receives the light reflected from the reflecting device 64, the processor 54 will immediately set the coordinate to the predetermined position such as (0,0). In this case the processor 54 can continuously update the coordinate according to the displacement signals when the joystick handle 14 is rotated and calibrate the coordinate whenever the joystick handle 14 reaches the predetermined upright position. No manual calibration is required.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A computer joystick comprising:

a housing having an opening at its top;

a joystick mechanism having two mutually perpendicular shafts rotatably installed inside the housing, a joystick handle rotatably installed in the opening of the housing, and an engaging means mounted at a bottom end of the joystick handle for rotatably engaging the two shafts;

two optical sensors installed in the housing next to the two shafts for detecting rotations of the two shafts and generating corresponding displacement signals;

a control circuit having a memory for storing a coordinate indicating a position of the joystick handle, and a processor wired to the two optical sensors for updating the coordinate according to the displacement signals generated by the two optical sensors and generating vector signals according to the coordinate to indicate the current position of the joystick handle; and a button installed on the housing and wired to the processor of the control circuit wherein the button is depressed when the joystick handle is not exerted by any external force to set a predetermined position as a starting coordinate of the joystick handle.

2. A computer joystick comprising:

a housing having an opening at its top;

a joystick mechanism having two mutually perpendicular shafts rotatably installed inside the housing, a joystick handle rotatable installed in the opening of the housing, and an engaging means mounted at a bottom end of the joystick handle for rotatably engaging the two shafts;

two optical sensors installed in the housing next to the two shafts for detecting rotations of the two shafts and generating corresponding displacement signals; and a control circuit having a memory for storing a coordinate indicating a position of the joystick handle, and a processor wired to the two optical sensors for updating the coordinate according to the displacement signals generated by the two optical sensors and generating vector signals, which are transmitted to a computer connected to the computer joystick, according to the coordinate to indicate the current position of the joystick handle;

wherein the computer can send a calibrating signal to the computer joystick and the processor of the control circuit will set a predetermined position as the coordinate of the joystick handle when receiving the calibrating signal.

3. A computer joystick comprising:

a housing having an opening at its top;

a joystick mechanism having two mutually perpendicular shafts rotatably installed inside the housing, a joystick handle rotatably installed in the opening of the housing, and an engaging means mounted at a bottom end of the joystick handle for rotatably engaging the two shafts;

two optical sensors installed in the housing next to the two shafts for detecting rotations of the two shafts and generating corresponding displacement signals;

a control circuit having a memory for storing a coordinate indicating a position of the joystick handle, and a processor wired to the two optical sensors for updating the coordinate according to the displacement signals generated by the two optical sensors and generating vector signals according to the coordinate to indicate the current position of the joystick handle; and a detector installed in the housing and wired to the processor of the control circuit for detecting the joystick handle at a predetermined position wherein the detector comprises a reflecting device installed at the bottom of the joystick handle for reflecting light, a light source and a light detector installed in the housing wherein when the joystick handle reaches the predetermined position, the light emitted from the light source will be reflected by the reflecting device and received by the light detector, and the processor will immediately set the predetermined position as the coordinate of the joystick handle when the light reflected from the reflecting device is received by the light detector of the detector.

* * * * *